US005610697A

United States Patent [19]

Arai

[11] Patent Number: 5,610,697

[45] Date of Patent: Mar. 11, 1997

[54] ELECTROPHOTOGRAPHIC APPARATUS CAPABLE OF PREVENTING IMAGE DETERIORATION ATTRIBUTABLE TO RESIDUAL TONER PARTICLES

[75] Inventor: Seiji Arai, Hachioji, Japan

[73] Assignee: Kabushiki Kaisha TEC, Tokyo, Japan

[21] Appl. No.: 519,237

[22] Filed: Aug. 25, 1995

[30] Foreign Application Priority Data

Aug. 31, 1994 [JP] Japan ..... 6-207179
Sep. 16, 1994 [JP] Japan ..... 6-222156

[51] Int. Cl.[6] ..... G03G 15/06; G03G 21/00

[52] U.S. Cl. ..... 399/149

[58] Field of Search ..... 355/269, 270, 355/296, 301, 303; 118/652; 15/256.5, 256.52

[56] References Cited

U.S. PATENT DOCUMENTS

| | | | |
|---|---|---|---|
| 5,124,757 | 6/1992 | Ikegawa | 355/296 |
| 5,294,964 | 3/1994 | Oshiumi | 355/270 |
| 5,321,471 | 6/1994 | Ito | 355/219 |
| 5,438,397 | 8/1995 | Okano et al. | 355/269 |

FOREIGN PATENT DOCUMENTS

| | | |
|---|---|---|
| 6-51672 | 2/1994 | Japan . |
| 6-102800 | 4/1994 | Japan . |

*Primary Examiner*—William J. Royer
*Attorney, Agent, or Firm*—Frishauf, Holtz, Goodman, Langer & Chick

[57] ABSTRACT

An electrophotographic apparatus including an electrically conductive brush roller for recovering and discharging a residual toner which is located in contact with a photoreceptor drum. A positive voltage is applied to a transfer roller, whereupon the toner is charged positively. As a recording region on the photoreceptor drum with an electrostatic latent image formed thereon passes the brush roller, a voltage of a potential lower than the potential of the recording region is applied to the brush roller, and the brush roller recovers the residual toner. As a non-recording region on the photoreceptor drum without the latent image thereon passes the brush roller, on the other hand, a voltage of a potential higher than the potential of the non-recording region is applied to the brush roller, and the recovered toner is discharged onto the non-recording region. The discharged toner is returned to a developing roller after a charging process.

8 Claims, 6 Drawing Sheets

ELECTROPHOTOGRAPHIC APPARATUS CAPABLE OF PREVENTING IMAGE DETERIORATION ATTRIBUTABLE TO RESIDUAL TONER PARTICLES

BACKGROUND OF THE INVENTION

1. Field of the Invention

The present invention relates to an electrophotographic apparatus such as a copying machine, and more particularly, to an electrophotographic apparatus for recovering paper dust from recording sheets and residual toner particles from the surface of a photoreceptor.

2. Description of the Related Art

In forming an image in a conventional electrophotographic apparatus, a photoreceptor is rotated and charged by a charging unit, an electrostatic latent image is formed by an exposure unit, and a toner image is formed by a developing unit. Subsequently, the toner image on the photoreceptor is transferred to a recording sheet by a transfer unit, and particles of a toner (residual toner particles) remaining on the photoreceptor are removed by a cleaning unit. The toner particles removed by the cleaning unit are abandoned as waste toner particles.

Furnished with the cleaning unit, however, the electrophotographic apparatus of this type is inevitably large-sized. Moreover, it is uneconomical to abandon the toner recovered by the cleaning unit, and it is troublesome to maintain the cleaning unit which entails a toner disposal process. In an electrophotographic apparatus of a type such that the waste toner is stored in a processing unit (incorporating a photoreceptor, developing unit, etc.), the life of the processing unit is restricted by the storage capacity for the waste toner.

In order to solve these problems, therefore, cleanerless electrophotographic apparatuses have been developed which simultaneously perform developing and cleaning processes. In the electrophotographic apparatuses with this arrangement, after a toner image on a photoreceptor is transferred to a recording sheet by a transfer unit, the residual toner on the photoreceptor is diffused by a stationary diffusion unit. Then, the residual toner is recharged by a charging unit, and is attracted and recovered by a developing roller of a developing unit after an exposure process. Thus, both the developing and the residual toner recovery are accomplished in the developing unit.

The cleanerless electrophotographic apparatuses can be classified into two known types. One is a two-component developing system which uses a two-component developing agent.

However, the two-component developing system used in the conventional electrophotographic apparatuses must be provided with a mechanism for controlling the toner concentration. Therefore, the developing unit is inevitably increased in size and weight, and there are restrictions on voltages applied to the charging unit and the developing roller. If the difference in potential between the photoreceptor and the developing roller is too great, particles of a carrier in the developing agent, which is opposite in polarity to the toner, fly, thereby lowering the performance of the photoreceptor and the image quality.

The other type is a non-contact system in which the photoreceptor is not in contact with the developing roller. According to the conventional non-contact electrophotographic apparatus, however, a DC-superposed AC voltage must be applied to the developing roller in order to increase the difference in potential between the photoreceptor and the developing roller, thus requiring expensive high-voltage power supply equipment.

In the developing unit used in this electrophotographic apparatus, moreover, the charge on the toner should be restricted to a low level in order to allow the toner to fly between the developing roller and the photoreceptor in an AC field. In this electrophotographic apparatus, the residual toner on the photoreceptor is recovered by means of the developing roller after it is recharged by the charging unit. In some cases, however, the toner may be overcharged by the charging unit, so that it cannot be recovered by the developing roller.

In order to solve the various problems of the conventional electrophotographic apparatuses described above, there has been developed an electrophotographic apparatus which incorporates a contact-type developing unit using a nonmagnetic one-component developing system. According to this developing system, a developing electrode is located close to an electrostatic latent image on a photoreceptor drum with a recording sheet and a toner between them, and an electrostatic latent image can be developed faithfully. If the residual toner on the photoreceptor is on a charging potential (white potential), therefore, it can be smoothly recovered by the developing roller.

In some cases, however, the electrophotographic apparatus of this type may suffer image deterioration from the following causes. One of the causes is the influence of paper dust. The paper dust, which is produced from the recording sheet as the sheet is transported, along with the residual toner remaining after a transfer process, adheres to the photoreceptor.

Talc in the paper dust is liable to be charged negatively, that is, it has a marked tendency to charge other materials positively. If the talc adhering to the photoreceptor is carried to the developing unit and recovered together with the residual toner by the developing unit, it will positively charge the negatively charged toner. If a developing operation is performed with use of this positively charged toner in the electrophotographic apparatus which incorporates a negatively charged organic photoreceptor adapted for the negatively charged toner, the toner adheres to a non-image portion, thereby producing a positive image or the so-called fogging which results in a lower image quality.

In the case where the developing unit is of a type such that the toner carried on the developing roller by means of a blade is charged by friction, paper dust sometimes may be jammed between the developing roller and the blade, thereby producing striped or low-quality images.

If an electrostatic latent image is formed on the surface of the photoreceptor with the paper dust thereon by means of the exposure unit, the shielding effect of the paper dust inevitably hinders satisfactory exposure. In this case, the toner cannot be allowed fully to adhere to the photoreceptor by means of the developing unit, so that the toner concentration is too low to prevent the formation of negative memories. Although the conventional electrophotographic apparatuses use the stationary diffusion unit to remove some of the infectious paper dust, their ability to remove the paper dust is not very high.

Another cause of the image deterioration is the influence of the residual toner.

The residual toner remaining on the surface of the photoreceptor after the transfer process is recovered by the developing roller of the developing unit. If the quantity of the residual toner is large, however, the residual toner cannot be recovered satisfactorily. Even after the developing process, therefore, the residual toner remains on the non-image portion of the photoreceptor, thereby forming a positive image. Possibly, moreover, the shielding effect of the toner particles may cause insufficient exposure in the exposure process by means of the exposure unit. In this case, the toner cannot be caused fully to adhere to the photoreceptor in the developing process, so that the toner concentration is too low to prevent the formation of negative memories. Although those problems can be solved to some degree by the use of the stationary diffusion unit, the solution is not satisfactory.

The prevailing versions of the conventional electrophotographic apparatuses use a negatively charged photoreceptor. Negative-charge corotron or scorotron chargers used in negative-charge electrophotographic apparatuses produce much ozone. It is feared that ozone lowers the performance of the photoreceptor. Positive-charge corotron or scorotron chargers produce one-tenth as much ozone as the negative-charge versions. Recently developed electrophotographic apparatuses use a positive-charge photoreceptor in consideration of the aforementioned influences of paper dust and ozone.

SUMMARY OF THE INVENTION

The present invention has been contrived in consideration of these circumstances, and an object of the invention is to provide a cleanerless electrophotographic apparatus capable of preventing deterioration of image quality, and more specifically, to provide an electrophotographic apparatus capable of preventing image deterioration which is attributable to the influence of paper dust from recording sheets. Another object of the invention is to provide an electrophotographic apparatus capable of preventing image deterioration which is attributable to the influence of residual toner particles. Still another object of the invention is to reduce the size and weight of the apparatus, reduce the cost, and prevent lowering of the performance of a photoreceptor, thereby improving the life performance of the apparatus.

According to an electrophotographic apparatus of the present invention, the outer peripheral surface of a brush roller, which is located between a transfer unit and a charging unit, is brought into contact with the surface of a photoreceptor. As the surface of the photoreceptor moves in an image recording operation, the outer peripheral surface of the brush roller also moves. Thereupon, paper dust from a recording sheet adhering to the photoreceptor surface is removed from the photoreceptor after a transfer process. This can be achieved because the paper dust, which is not so closely in contact with the photoreceptor as particles of a toner, can be removed from the photoreceptor as the brush roller rotates. If any unremoved paper dust gets into the developing unit, it cannot prevent the toner from being charged, since the toner is positively charged. Thus, positive or negative images cannot be produced, and image deterioration attributable to the influence of paper dust from the recording sheet can be prevented, so that good image quality can be secured for a long period of time. Moreover, the paper dust on the photoreceptor can be removed more securely by applying a positive voltage to a brush which is formed of a material with a resistance of about $10^8$ ohms.

According to the electrophotographic apparatus of the present invention, furthermore, when a recording region on the photoreceptor drum which carries an electrostatic latent image thereon passes the brush roller, a voltage of a potential lower than the potential of the recording region is applied to the brush roller, whereupon the brush roller recovers the residual toner. When a non-recording region on the photoreceptor drum which has no electrostatic latent image formed thereon passes the brush roller, on the other hand, a voltage of a potential higher than the potential of the non-recording region is applied to the brush roller, whereupon the recovered toner is discharged onto the non-recording region. The discharged toner is returned to the developing roller after a charging process. In this manner, the residual toner can be smoothly recovered by the developing roller as the brush bias voltage is switched between the recording and non-recording regions.

Thus, the electrophotographic apparatus can be reduced in size and weight, and hence, in manufacturing cost, and besides, the toner can be used effectively. Since the life performance of the photoreceptor is improved, moreover, the cost of expendables is reduced, and the maintenance of the apparatus is facilitated. Owing to the use of the positively charged organic photoreceptor and the transfer roller, furthermore, production of ozone can be reduced, and the life performance of the unit can be improved without adversely affecting members in the unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
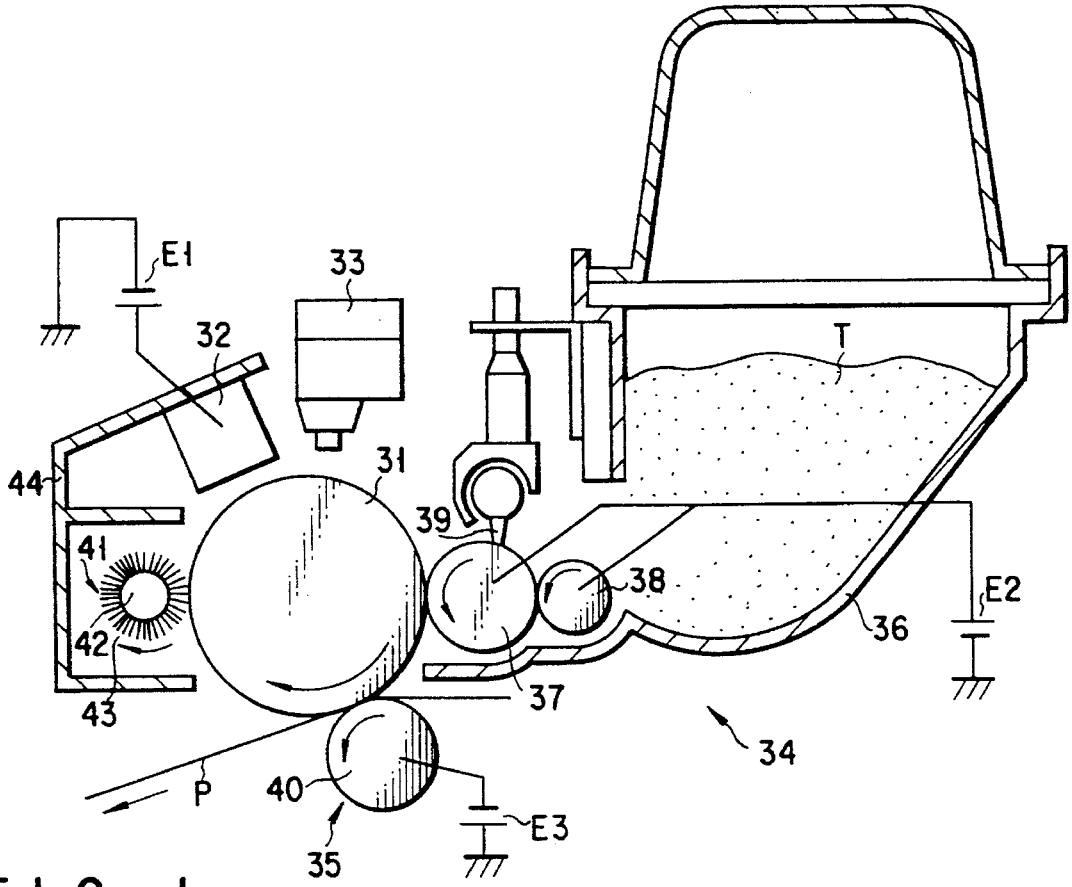
FIG. 1 is a schematic view showing an electrophotographic apparatus according to a first embodiment of the present invention.
Figure 3:
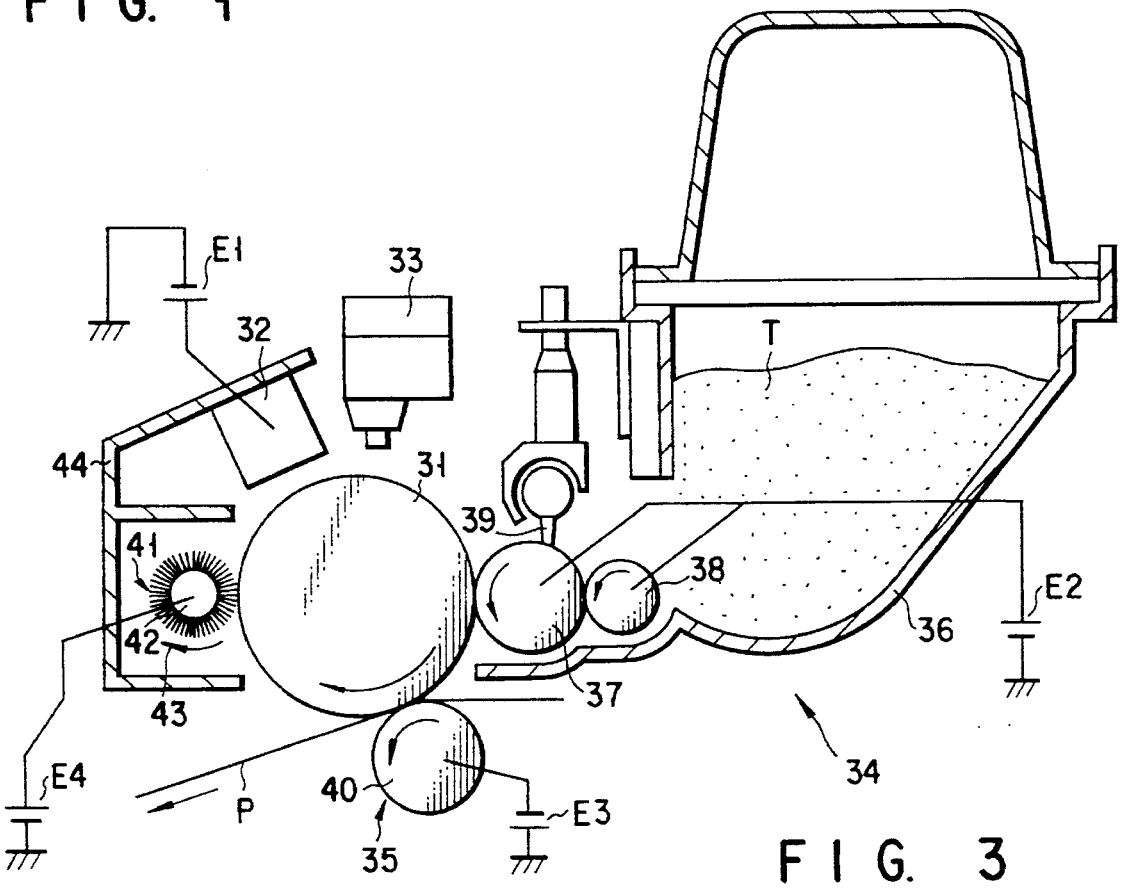
FIG. 3 is a schematic view showing an electrophotographic apparatus according to a second embodiment of the invention.

Referring now to FIGS. 1 to 3, a first embodiment of the present invention will be described.

FIG. 1 shows an outline of an electrophotographic apparatus. In FIG. 1, numeral 31 denotes a photoreceptor which, having the shape of, e.g., a drum, is formed of a photoconductive material such as aluminum, which is charged positively, for example. The photoreceptor 31 is rotated in the direction indicated by the arrow in FIG. 1 by means of a drive mechanism (not shown) for rotation. Arranged around the photoreceptor 31 are a main charger 32, exposure unit 33, developing unit 34, and transfer unit 35.

The charger 32 positively charges the surface (outer peripheral surface) of the photoreceptor 31 to, for example, +600 volts. The charger 32 is composed of a scorotron charger which is supplied with voltage from a DC power source E1 (e.g., +4.2 kV) and provides current of 200 μÅ. The exposure unit 33, which forms an electrostatic latent image on the surface of the photoreceptor 31, is composed of an exposure element, such as a light emitting diode (LED). The unit 33 is situated on the lower-course side of the charger 32 with respect to the rotating direction of the photoreceptor 31. Since the exposure unit 33 and the photoreceptor 31 are not in contact with each other, there is no possibility of their being damaged by friction.

The developing unit 34 develops the electrostatic latent image on the surface of the photoreceptor 31 into a toner image by using, for example, a one-component contact reverse developing system. The unit 34 is situated on the lower-course side of the exposure unit 33 with respect to the rotating direction of the photoreceptor 31. The developing unit 34 includes a toner hopper 36, developing roller 37, toner supply roller 38, and blade 39. The hopper 36 is stored with a one-component toner T. The roller 37 extends parallel to the photoreceptor 31 so as to be rotatable with its surface in contact with the surface of photoreceptor 31. The roller 38 extends parallel to the roller 37 for rotation. The blade 39 is located in a fixed position, extending parallel to the developing roller 37, and is in contact with the surface of the roller 37. The rollers 37 and 38 are rotated in the directions of the arrows, and are supplied with voltage (e.g., +300 volts) from a DC power source E2. The developing unit 34 also has a cleaning function to recover the toner T remaining on a white image region of the exposed photoreceptor 31.

The transfer unit 35 is situated on the lower-course side of the developing unit 34 with respect to the rotating direction of the photoreceptor 31. According to this embodiment, the electrophotographic apparatus to be described in the following paragraphs uses a contact transfer system such that the transfer unit 35 includes a transfer roller 40 which is in contact with the surface of the photoreceptor 31. The roller 40 is rotated in the direction indicated by the arrow by means of a drive unit (not shown) for rotation, and is supplied with voltage (e.g., −1,000 volts) from a DC power source E3. In the case of a non-contact transfer unit, such as the corotron type, the toner transfer efficiency and the quantity of residual toner vary depending on the surrounding conditions. This may be able to be avoided by stabilizing the electrical discharge with use of a scorotron-type transfer unit. The scorotran-type transfer unit, however, is expensive. Preferably, therefore, the transfer unit should be of the contact type, although it may possibly be of the non-contact type.

The contact-type transfer unit, however, is subject to a heavier paper dust build-up than the non-contact type. (The paper dust build-up is also caused in the case of the non-contact type as the recording sheet is fed.)

A brush roller 41 is located close to the photoreceptor 31 between the transfer unit 35 and the charger 32. The roller 41 serves to remove paper dust from the surface of the photoreceptor 31. The brush roller 41 has a shaft 42 which is equal in length to, for example, the photoreceptor 31. The shaft 42 is planted with a large number of bristles 43 which are radially arranged throughout the circumference of the shaft 42. Preferably, the bristles 43 are planted so that they can be in contact with the whole surface of the photoreceptor 31 with respect to the axial direction thereof. Alternatively, however, the bristles 43 may be planted partially on the photoreceptor 31 so as to cover a predetermined width in the axial direction. The bristles 43 are formed of a material such that they can remove paper dust satisfactorily from the surface of the photoreceptor 31. For example, they are formed of a material which is prepared by dispersing carbon in rayon. The plantation density of the bristles 43 is settled in consideration of the performance for the removal of paper dust.

The brush roller 41 extends parallel to the photoreceptor 31, and is rotatably supported by means of a member (not shown) so that the tip end of each bristle 43 is in contact with the surface of the photoreceptor 31. The basic function of the roller 41 is to remove paper dust from the surface of the photoreceptor 31 in a manner such that the outer peripheral surface of the brush moves in contact and simultaneously with the photoreceptor surface. Thus, the brush roller 41 may be designed so as to rotate accompanying the rotation of the photoreceptor 31. Alternatively, the brush roller 41 may be rotated in the forward or reverse direction with respect to the rotating direction of the photoreceptor 31 by means of a drive unit (not shown) for rotation. In this case, the shaft 42 is rotated by the drive unit.

In rotating the brush roller 41 in the forward direction (counterclockwise direction of FIG. 1) with respect to the rotating direction of the photoreceptor 31, the respective peripheral speeds of the roller 41 and the photoreceptor 31 may be made equal or different. In the case where the peripheral speeds of the two rotating bodies are differentiated, the rotating speed of the roller 41 is adjusted suitably. Also in rotating the brush roller 41 in the reverse direction (clockwise direction of FIG. 1) with respect to the rotating direction of the photoreceptor 31, the rotating speed of the roller 41 is adjusted suitably. In practice, a great effect can be obtained in the case where the brush roller 41 is rotated in the reverse direction with respect to the rotating direction of the photoreceptor 31 by the drive unit or is rotated with a difference in peripheral speed in the forward direction. Since paper dust has good releasability, it can readily scatter from the brush roller 41 without being held when it is scraped off by means of the brush roller. Numeral 44 denotes a casing which receives the scattered paper dust from the brush roller 41.

The following is a description of the operation of the electrophotographic apparatus according to the present invention constructed in this manner. The photoreceptor 31 is rotated in the direction indicated by the arrow in FIG. 1 by means of the drive mechanism for rotation. As the photoreceptor 31 rotates, the following operations are performed.

First, the surface of the photoreceptor 31 is charged to a predetermined positive potential of, e.g., 600 volts or thereabout by corona discharge of the charger 32 which is based on scorotron charging. Then, an electrostatic image corresponding to image information is formed on the surface of the photoreceptor 31 by the exposure unit 33. The exposure unit 33 flickers the LED in accordance with the image information, thereby effecting exposure. The latent image formed by the exposure is a negative latent image with its image portion cleared of electric charge. Thus, the potential of a black image region is low, while that of a white image region is high.

Subsequently, a toner image corresponding to the electrostatic image is formed on the surface of the photoreceptor 31. More specifically, the one-component toner T stored in the hopper 36 is fed to the developing roller 37 by the rotating supply roller 38. The toner T is transported toward the photoreceptor 31 by the rotating developing roller 37. In the middle of the transportation, the toner T is brought into contact with the blade 39 to be positively charged and formed into a thin layer. The positively charged toner T is caused by the developing roller 37 to adhere to the electrostatic latent image or charge-free portion on the surface of the photoreceptor 31 by means of Coulomb force, thereby forming the toner image (reverse developing). In the developing unit 34, at the same time, the toner T remaining on the white image region or high-potential region of the photoreceptor 31, exposed in the aforesaid manner, is attracted to the developing roller 37 to be recovered for cleaning.

Then, in the transfer unit 35, a recording sheet P is transported between the photoreceptor 31 and the transfer roller 40, which rotates as it is supplied with the negative voltage from the DC power source E3, whereupon the toner image on the photoreceptor 31 is transferred to the sheet P. In this transfer process, about 10 to 25% of the toner T having so far been adhering to the surface of the photoreceptor 31 remains thereon without being transferred to the recording sheet P. At the same time, paper dust S from the sheet P adheres to the surface of the photoreceptor 31. Since the recording sheet P is pressed against the photoreceptor surface by means of the transfer roller 40, in particular, plenty of paper dust S adheres to the photoreceptor 31.

Figure 2A:
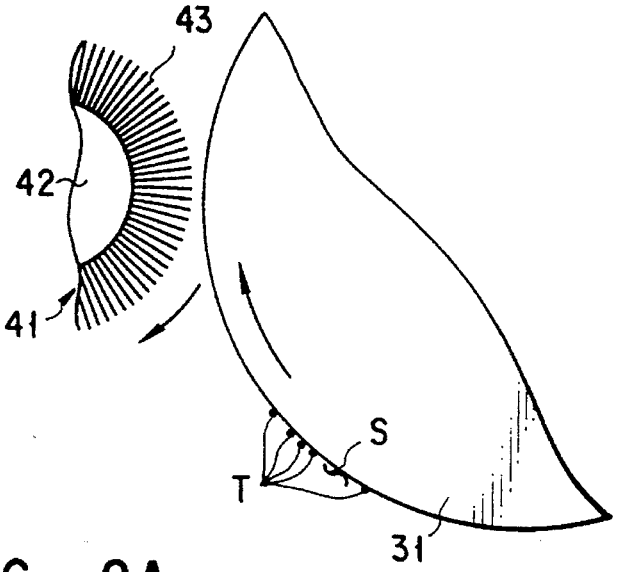
FIGS. 2A, 2B and 2C are diagrams for illustrating the operation of a brush.
Figure 2B:
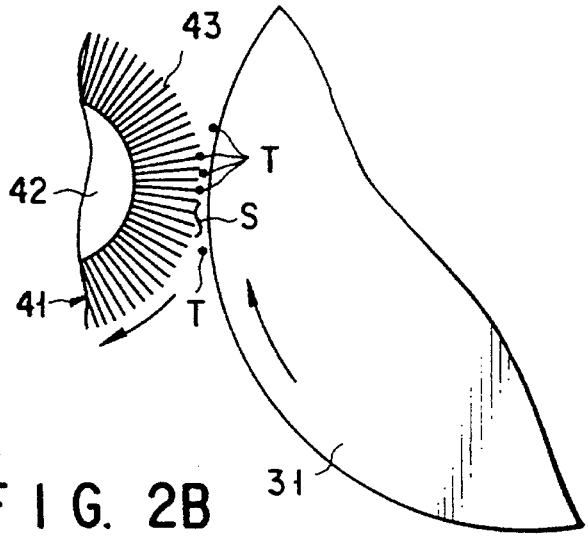
Figure 2C:
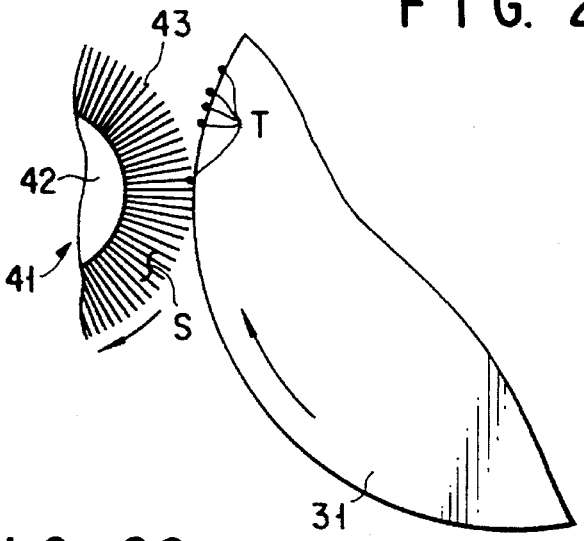

As the photoreceptor 31 rotates, the toner T and the paper dust S on the surface of the photoreceptor 31 move toward the brush roller 41, as shown in FIG. 2A. Then, the paper dust S on the photoreceptor 31 is removed by the brush roller 41 which is forced to rotate in the direction of the arrow in FIG. 2A. As the shaft 42 rotates, as shown in FIGS. 2B and 2C, the brush bristles 43 rotate and come successively into sliding contact with the surface of the photoreceptor 31, thereby removing the paper dust S from the photoreceptor surface. In particular, talc contained in the paper dust S from the recording sheet P is removed from the surface of the photoreceptor 31. At this time, the toner T remaining on the photoreceptor surface is only diffused by means of the brush roller 41, and cannot be removed from the photoreceptor 31 after the diffusion. This is because the toner T is stuck fast to the photoreceptor 31 by Coulomb force, although the paper dust S is only attracted to the photoreceptor 31 by a very small electrostatic force. Another reason is that the paper dust S, especially the talc therein, has good slip properties. Since the paper dust is thus removed from the photoreceptor by means of the brush roller 41, there is no possibility of its hindering the exposure or being jammed between the developing roller and the blade so that the resulting image is striped.

After the paper dust S is removed by the brush roller 41, only the residual toner T goes to a charging process, whereupon it is further positively charged by the main charger 32. In a developing process, the residual toner T is attracted to the developing roller 37 of the developing unit 34 by means of image force.

In some cases, the paper dust S may remain on the surface of the photoreceptor 31 without being removed despite the use of the brush roller 41. Since the amount of remaining paper dust is very small, however, the possibility of its hindering the exposure or being jammed between the developing roller and the blade is negligible. Since a positive-charge developing unit is used in the present embodiment, moreover, the talc never causes fogging. Thus, the paper dust S from the developing roller 37 gets into the hopper 36 to be mixed with the toner T. In an electrophotographic apparatus using the conventional negative-charge developing unit, the toner is negatively charged in a normal state. However, the toner T in the vicinity of the paper dust S is positively charged by the talc contained in the paper dust. This is done because the toner T is positively charged by a charging system in frictional charging between the paper dust S and the toner T. As a result, the positively charged toner adheres to the surface of the negatively charged photoreceptor, so that the so-called fogging occurs. With use of the positive-charge developing unit and the positively charged toner T, however, reliable developing properties can be maintained without hindering the toner charging.

Referring now to FIG. 3, a second embodiment of the present invention will be described.

In FIGS. 1 and 3, like reference numerals refer to like portions. In this embodiment, bristles 43 of a brush roller 41 are formed of a material having a resistivity which covers a range from conduction to medium resistance. For example, the brush bristles 43 are formed of a material which is prepared by dispersing carbon in rayon and has an electrical resistance of about $10^6\Omega\cdot$cm. Positive voltage from a DC power source E4 is applied to the bristles 43. Accordingly, a shaft 42 of the brush roller 41 is formed of an electrically conductive material, and is connected electrically to a DC power source E4.

Thus, the brush bristles 43 applies an electrical force of attraction to paper dust S adhering to the surface of a photoreceptor 31, whereby the effect of positively separating the paper dust from the photoreceptor surface is improved. This is because talc in the paper dust S is negatively charged by a charging system so that the removing force can be increased by applying positive voltage to the brush bristles 43. In this case, most of the residual toner is positive in polarity, so that it is repelled by the brush bristles. Thus, very little adheres to the brush.

Figure 4:
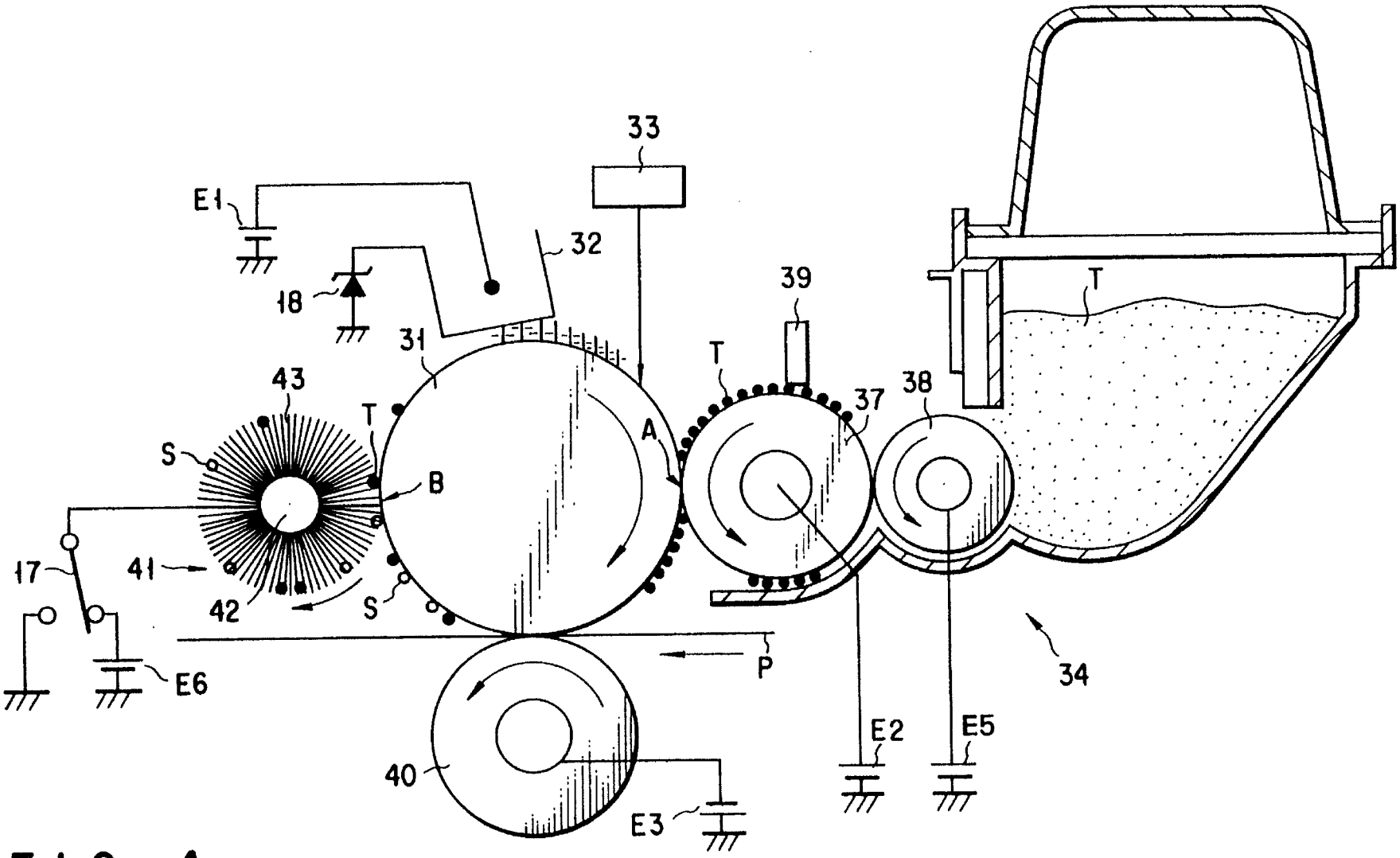
FIG. 4 is a schematic view showing an electrophotographic apparatus according to a third embodiment of the invention.

Referring now to FIG. 4, an arrangement according to a third embodiment of the present invention will be described in which the toner remaining on the photoreceptor without being transferred to the recording sheet is recovered satisfactorily by means of a developing unit. Like reference numerals are used to designate like portions in FIGS. 1 and 4, and only different portions will be described in the following.

Numeral 18 denotes a Zener diode which restricts the charging potential of a photoreceptor 31 to +600 volts. E5 designates a power source for applying a bias voltage of +400 volts to a supply roller 38, and E6 designates a power source for applying a bias voltage of +300 volts to a conductive brush roller 41. When a switch 17 is shifted, the bias voltage of +300 volts is applied as that region of the photoreceptor 31 on which no electrostatic latent image is formed, that is, a non-recording region, passes the brush roller 41. On the other hand, a bias voltage of 0 volts is applied as that region of the photoreceptor 31 on which a latent image is formed, that is, a recording region, passes the roller 41. This electrode operation is intended to control the attraction and discharge of the toner. Paper dust is separated as the brush roller is brought into contact with the photoreceptor. Since the toner is positive in polarity, according to the present embodiment, the influence of the talc upon the toner is negligible even though some paper dust fails to be removed.

Referring now to FIG. 4, operation for an image recording process of an electrophotographic apparatus according to the present embodiment will be described. In image recording, the following operation is performed in the process of rotating the photoreceptor 31.

First, the surface of the photoreceptor 31 is charged to 600 volts by means of a scorotron charger 32. Then, the photoreceptor surface (not shown) is exposed by means of an exposure unit 33 in accordance with image data, whereupon an electrostatic latent image is formed on the photoreceptor surface. In this case, the potential of a black image region is 150 volts, while that of a white image region remains at 600 volts. In a developing unit 34, the toner is caused to adhere to the surface of the photoreceptor 31 by means of a developing roller 37 in accordance with the latent image on the photoreceptor surface, whereupon a toner image is formed. Subsequently, the toner image on the photoreceptor 31 is transferred to a recording sheet P by means of a transfer roller 40. In this process, as mentioned before, all the toner T on the photoreceptor 31 is not transferred to the sheet P, and 10 to 20% of the toner is left on the surface of the photoreceptor 31.

Referring now to FIGS. 5 to 9, a process of recovering the residual toner on the photoreceptor 31 by means of the developing roller 37 after the transfer will be described.

Figure 5:
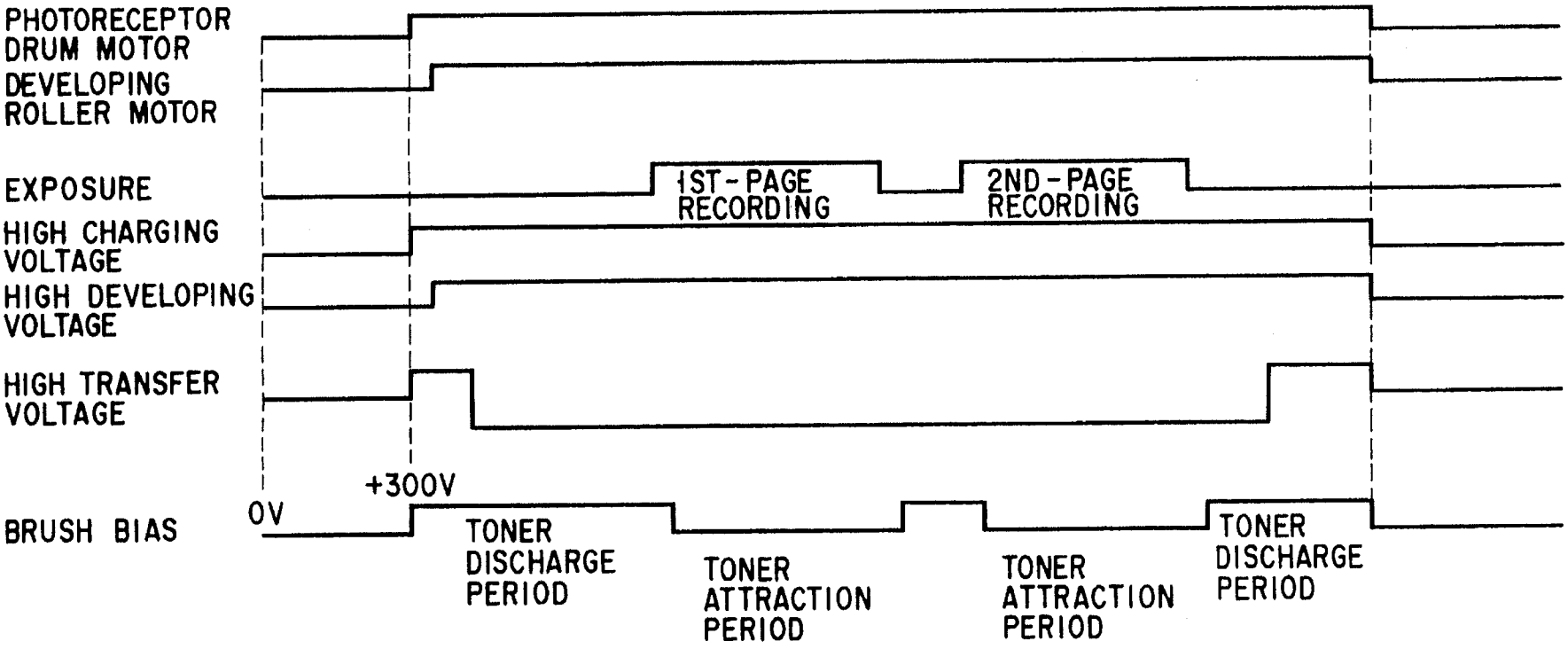
FIG. 5 is a timing chart showing process control according to the third embodiment.

FIG. 5 is a timing chart for process control, showing operation timings for the photoreceptor (drum), developing roller, exposure unit, main charger, transfer roller, and conductive brush roller. The lowest diagram of the timing chart, in particular, indicates that the bias voltage of the conductive brush roller 41 can be switched between the recording and non-recording regions of the photoreceptor. More specifically, the bias voltage is 0 volts for the recording region and 300 volts for the non-recording region.

Figure 6:
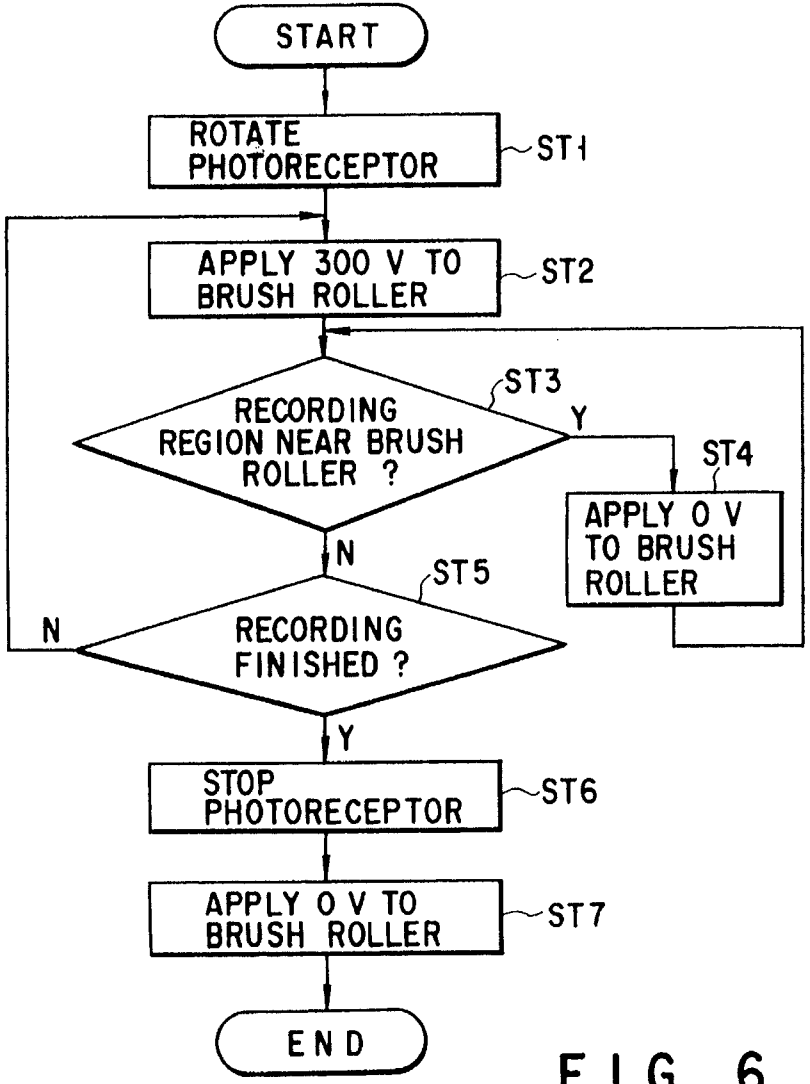
FIG. 6 is a flowchart showing brush roller bias control.

FIG. 6 is a flowchart showing details of control of the rotation of the photoreceptor 31 and the voltage applied to the brush roller 41. When recording operation is started first, the photoreceptor is rotated (ST1), and the switch 17 is shifted to the E6 side so that the voltage of 300 volts is applied to the brush roller 41 (ST2). After the exposure, developing, and transfer processes, it is determined whether or not the recording region on the photoreceptor is located close to the brush roller (ST3). If the decision in Step ST3 is YES, the switch 17 is shifted to the ground potential side so that a voltage of 0 volts is applied to the brush roller 41 (ST4). At this time, the residual toner on the recording region is attracted to the brush roller 41. If it is concluded in Step ST3 that the recording region is not located close to the brush roller, that is, the non-recording region is in the vicinity of the brush roller, the voltage of 300 volts is applied to the brush roller (ST2) after it is determined whether or not the recording operation is finished (ST5). At this time, the toner attracted to the brush roller is discharged onto the non-recording region of the photoreceptor 31. The discharged toner is charged to 600 volts, and then recovered by the developing roller 37. If it is concluded in Step ST5 that the recording operation is finished, the rotation of the photoreceptor is stopped (ST6), and a voltage of 0 volt is applied to the brush roller (ST7).

The residual toner recovered by the brush roller never fails to be discharged onto the non-recording region of the photoreceptor without the toner thereon. Accordingly, there is no possibility of the quantity of the residual toner increasing in a specific region of the photoreceptor. Thus, the residual toner can be securely recovered by the developing unit.

If the residual toner is too much, it sometimes cannot be recovered by the developing unit, and may cause image defects. It is essential, therefore, to be sure to discharge the toner onto the non-recording region of the photoreceptor which carries no toner thereon.

Figure 7:
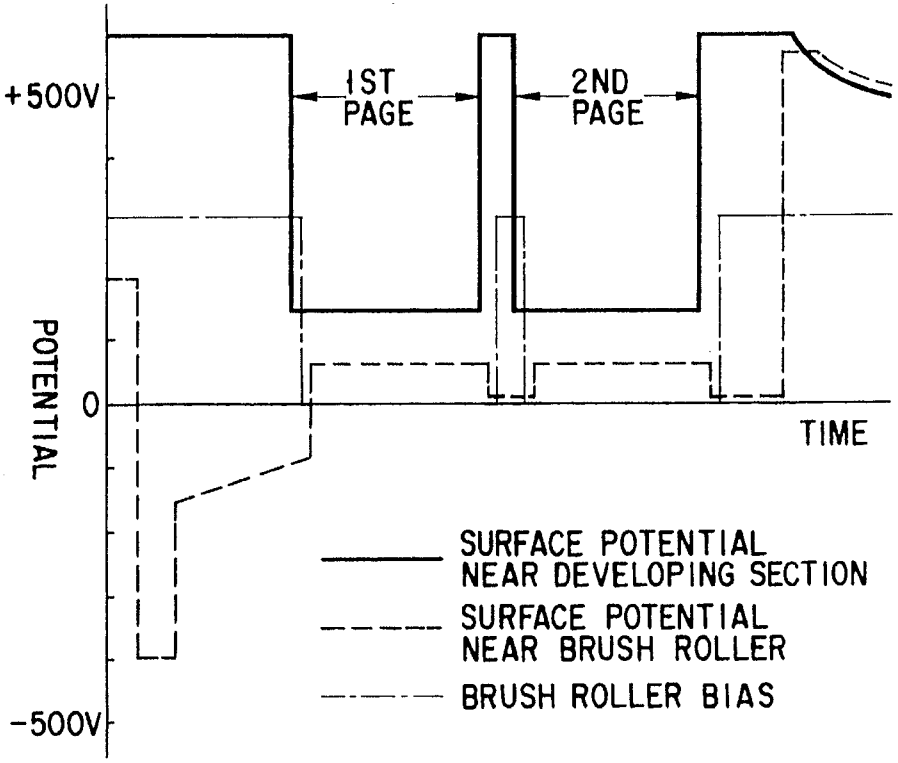
FIG. 7 is a diagram showing waveforms of photoreceptor surface potentials near a transfer unit and a brush roller obtained after black printing according to the third embodiment.

FIG. 7 is a diagram showing surface potentials near the developing unit 34 (A of FIG. 4) and the conductive brush roller 41 (B of FIG. 4) obtained when a black image is printed under the process control shown in FIG. 5. For simplicity of illustration, the surface potential of the white image region in the recording region is not shown in FIG. 7. As indicated by the waveform (broken line) of FIG. 7 for the surface potential near the brush roller, the potential of the toner T and the paper dust S on the recording region after the passage through the transfer roller 40 is about 70 volts. It is because the photoreceptor 31 is charged to the negative side by the transfer roller 40 that the photoreceptor potential is reduced to 70 volts from 150 volts for the point of time immediately after the exposure.

As seen from the brush roller bias waveform (dashed line) of FIG. 7, a voltage of 0 volts from the power source E6, which is lower than the potential of the photoreceptor 31, is applied to the conductive brush roller 41. When the surface of the photoreceptor 31 comes into contact with the brush roller 41, therefore, the positively charged toner T (+70 volts) on the photoreceptor surface is attracted to the brush roller 41 by the difference in potential between the photoreceptor 31 and the roller 41. On the other hand, a very small quantity of negatively charged toner T on the surface of the photoreceptor 31 passes by the brush roller 41 as it is.

Figure 8:
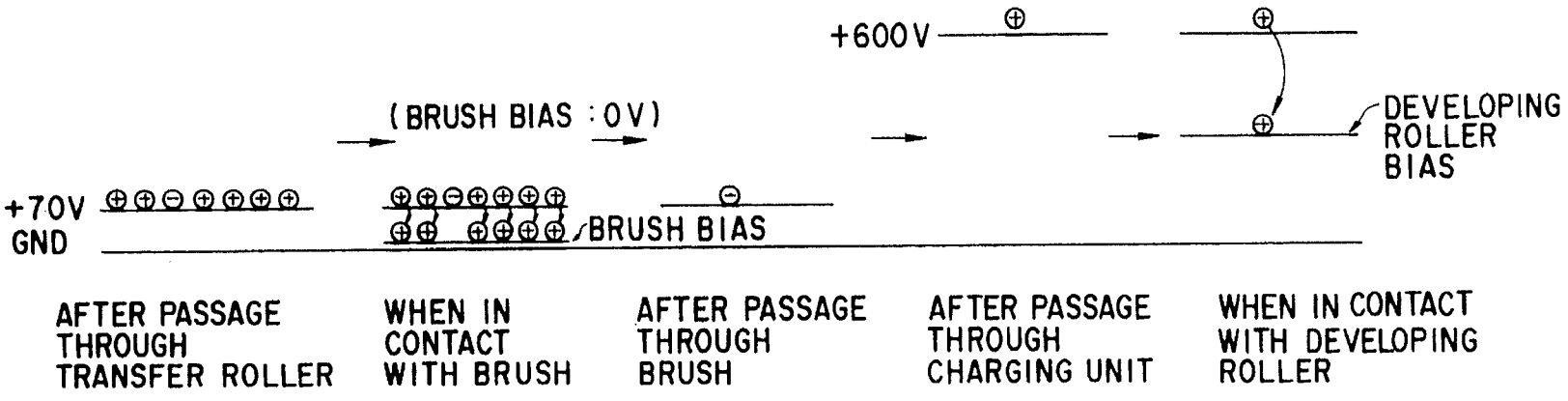
FIG. 8 is a diagram showing changes of residual toner particles on a recording region of a photoreceptor according to the third embodiment.

FIG. 8 is a diagram showing the way the residual toner T on the recording region of the photoreceptor 31 moves from the transfer roller 40 to the developing unit 34 as the photoreceptor 31 rotates. More specifically, FIG. 8 shows potential changes and movements at the points of time after the passage of the residual toner through the transfer roller, when the residual toner is in contact with the brush roller, after the passage through the brush roller, after the passage through the charging unit, and when the residual toner is in contact with the developing roller. In FIG. 8, a circled plus sign represents a positively charged toner particle, and a circled minus sign a negatively charged one.

As shown in FIG. 8, a very small quantity of negatively charged toner on the photoreceptor 31 passes by the conductive brush roller 41 as it is. The potential of the negatively charged residual toner is inverted in polarity and raised to +600 volts by the charging unit 32, and is subjected to the exposure process by the exposure unit 33. Since hardly any toner exists on the surface of the photoreceptor 31 in this state, there is no possibility of the residual toner hindering the exposure process and producing negative or positive images. In the developing unit 34, the residual toner is attracted to the developing roller 37, which is biased to 300 volts by the power source E2, whereby it is recovered securely.

When the conductive brush roller 41 is passed, the white-potential portion of the recording region on the photoreceptor 31 is attenuated 200 volts (not shown). This is caused as the photoreceptor 31 is charged to the negative side by the transfer roller 40. Since the potential of the brush roller 41 is biased to a voltage of 0 volts, the positively charged toner accumulated on the roller 41 can never be returned to the white-potential portion.

The following is a description of the process in which the positively charged toner attracted to the conductive brush roller 41 from the recording region on the photoreceptor 31 is recovered by the developing roller 37 via the non-recording region on the photoreceptor.

As shown in the timing chart of FIG. 5, the bias voltage of +300 volts from the power source E6 is applied to the conductive brush roller 41 when the non-recording region (other region than recording regions for first and second pages) on the photoreceptor 31 moves near the brush roller. As seen from the waveform of FIG. 7 for the surface potential near the brush roller, the surface potential of the photoreceptor 31 near the brush roller 41 is on the negative side before the recording region for the first page that moves near the brush roller, and the non-recording region (between pages and after recording) are charged to a voltage of 0 volts or thereabout. This is because the non-recording region on the photoreceptor 31 comes directly into contact with the transfer roller which is supplied with a negative voltage.

Figure 9:
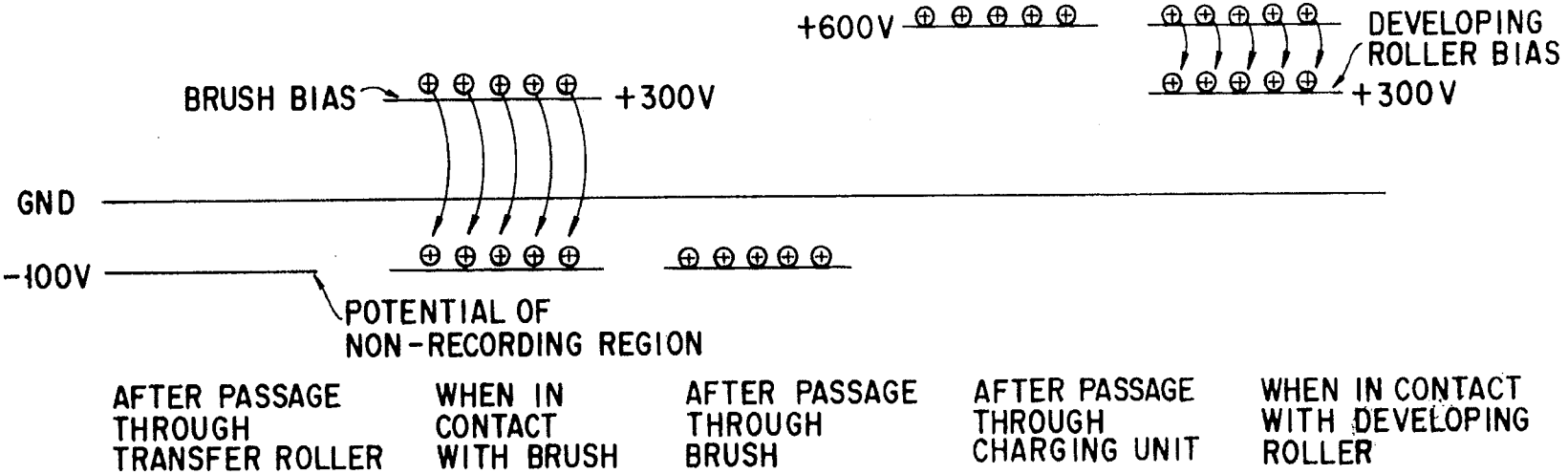
FIG. 9 is a diagram showing changes of residual toner particles on a non-recording region of the photoreceptor according to the third embodiment.

When the non-recording region passes through the region B near the conductive brush roller 41, a voltage (300 volts) higher than the aforesaid potential is applied to the roller 41. FIG. 9 is a diagram showing the process in which the positively charged toner attracted to the brush roller 41 is recovered by the developing roller 37 via the non-recording region on the photoreceptor. More specifically, FIG. 9 shows potential changes and movements of the residual toner at the points of time after the passage of the non-recording region through the transfer roller, when the non-recording region is in contact with the brush roller, after the passage through the brush roller, after the passage through the charging unit, and when the non-recording region is in contact with the developing roller. In FIG. 9, a circled plus sign represents a positively charged toner particle.

As shown in FIG. 9, no toner exists on the non-recording region of the photoreceptor 31 after the transfer roller 40 is passed. This is because the toner cannot be caused to adhere to the non-recording region of the photoreceptor 31 by the developing unit 34 since the potential of the non-recording region during the exposure is a white potential.

As the non-recording region of the photoreceptor 31 passes the non-recording region, the positively charged toner in the recording region attracted to the brush roller 41 is returned to the non-recording region of the photoreceptor 31 by the difference in potential between the roller 41 and the photoreceptor 31. The returned toner is recharged by the charging unit 32, and its potential is raised close to +600 volts. Then, the toner is attracted and recovered by the developing roller 37 which is biased to 300 volts. In the present embodiment, the attraction and discharge of the residual toner and the removal of the paper dust are carried out by means of the brush roller 41, so that the quality of resulting images can be effectively prevented from being lowered by the residual toner and the paper dust. Further, the attraction and discharge of the toner are achieved by only manipulating the potential of the brush, so that the construction is simple.

According to the present invention, an intermittent cut-sheet feeding test was conducted for 18.5K sheets (5%-black recording). In this test, the total toner consumption was 504 g, the toner build-up on the conductive brush roller 41 was 2 g, and neither negative or positive images were produced. If the transfer efficiency for the transfer process is 80%, then about 100 g of residual toner can be supposed to have been produced. In this case, about 98% of the residual toner should be recovered by the developing unit 34. These test results indicate that the developing and cleaning operations can be performed simultaneously and smoothly in the developing unit 34 according to the invention.

It is to be understood that the present invention is not limited to the embodiment described above, and that various changes and modifications may be effected therein by one skilled in the art without departing from the scope or spirit of the invention. For example, the photoreceptor is not limited to the drumshaped structure, and may be in any other suitable form. Also, the recording medium may be in any other form than a sheet, and the brush is not limited to the columnar form, and may, for example, be a belt-shaped structure. Furthermore, the transfer unit may alternatively be of the non-contact type, and the charging unit may be of the contact type.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrophotographic apparatus comprising:

a photoreceptor formed of a photoconductive material and adapted to be rotated at a time of image formation;

charging means for charging the photoreceptor;

exposure means, situated on a lower-course side of the charging means with respect to a rotating direction of the photoreceptor, for exposing the photoreceptor to form an electrostatic latent image thereon;

developing means, situated on a lower-course side of the exposure means with respect to the rotating direction of the photoreceptor, for causing a nonmagnetic one-component developing agent to adhere to the photoreceptor to thereby develop the electrostatic latent image into a toner image;

transfer means, situated on a lower-course side of the developing means with respect to the rotating direction of the photoreceptor, for transferring the toner image to a recording sheet;

an electrically conductive member situated on a lower-course side of the transfer means with respect to the rotating direction of the photoreceptor and adapted to be in contact with the photoreceptor;

determination means for determining whether or not an image recording region on the photoreceptor on which the electrostatic latent image has been formed is located in the vicinity of the conductive member;

first application means for applying a voltage of a first potential, different from a potential of the image recording region on the photoreceptor, to the conductive member when the determination means determines that the image recording region is located in the vicinity of the conductive member, whereby a residual toner remaining on the photoreceptor after transfer by the transfer means is collected by the conductive member;

second application means for applying a voltage of a second potential, different from the first potential, to the conductive member when the determination means determines that the image recording region is not located in the vicinity of the conductive member, whereby the residual toner collected by the conductive member is discharged onto a non-image recording region on the photoreceptor, charged by the charging means, and then returned to the developing means.

2. An electrophotographic apparatus comprising:

a photoreceptor formed of a positively charged photoconductive material and adapted to be rotated at a time of image formation;

charging means for positively charging the photoreceptor;

exposure means, situated on a lower-course side of the charging means with respect to a rotating direction of the photoreceptor, for exposing the photoreceptor to form an electrostatic latent image thereon;

developing means, situated on a lower-course side of the exposure means with respect to the rotating direction of the photoreceptor for causing a positively charged nonmagnetic one-component developing agent to adhere to the photoreceptor to thereby develop the electrostatic latent image into a toner image;

transfer means, situated on a lower-course side of the developing means with respect to the rotating direction of the photoreceptor, for transferring the toner image to a recording sheet;

an electrically conductive member situated on a lower-course side of the transfer means with respect to the rotating direction of the photoreceptor and adapted to be in contact with the photoreceptor;

determination means for determining whether or not an image recording region on the photoreceptor on which the electrostatic latent image has been formed is located in the vicinity of the conductive member;

first application means for applying a first voltage, having a potential lower than a potential of the image recording region on the photoreceptor, to the conductive member when the determination means determines that the image recording region is located in the vicinity of the conductive member, whereby a residual toner remaining on the photoreceptor after transfer by the transfer means is collected by the conductive member; and second application means for applying a second voltage, having a potential higher than a potential of a non-image recording region on the photoreceptor, to the conductive member when the determination means determines that the image recording region is not located in the vicinity of the conductive member, whereby the residual toner recovered by the conductive member is discharged onto the non-image recording region and then returned to the developing means via the charging means.

3. An apparatus according to claim 2, wherein said conductive member is rotatable in contact with the photoreceptor.

4. An apparatus according to claim 2, wherein said transfer means comprises a contact type transfer unit which is in contact with the recording sheet as the transfer unit transfers the toner image to the recording sheet.

5. An apparatus according to claim 3, wherein said transfer means comprises a contact type transfer unit which is in contact with the recording sheet as the transfer unit transfers the toner image to the recording sheet.

6. An apparatus according to claim 3, wherein said conductive member comprises a columnar brush.

7. An apparatus according to claim 6, wherein said transfer means comprises a contact type transfer unit which is in contact with the recording sheet as the transfer unit transfers the toner image to the recording sheet.

8. An apparatus according to claim 7, wherein said charging means includes means for charging the photoreceptor without coming into contact with the photoreceptor.

* * * * *